US006460396B1

(12) United States Patent
Smedberg et al.

(10) Patent No.: US 6,460,396 B1
(45) Date of Patent: Oct. 8, 2002

(54) POWER PRESS

(75) Inventors: Kenneth L. Smedberg, Crete; George J. Bozich, Chicago; Ronald S. Boge, Worth, all of IL (US)

(73) Assignee: Metalforming Controls Corp., Cary, IL (US)

( * ) Notice: Subject to any disclaimer, the term of this patent is extended or adjusted under 35 U.S.C. 154(b) by 0 days.

(21) Appl. No.: 09/864,832

(22) Filed: May 24, 2001

Related U.S. Application Data

(63) Continuation of application No. 09/203,133, filed on Dec. 1, 1998, now Pat. No. 6,237,381.

(51) Int. Cl.[7] ..... B21D 24/14

(52) U.S. Cl. ..... 72/453.13; 72/19.9; 72/20.2; 72/351; 267/119; 100/259

(58) Field of Search ..... 72/19.9, 20.2, 72/351, 453.13, 350; 267/119; 100/259

(56) References Cited

U.S. PATENT DOCUMENTS

| | | | | |
|---|---|---|---|---|
| 4,732,033 | A | 3/1988 | Smedberg et al. | 72/453.13 |
| 4,736,615 | A | 4/1988 | Smedberg et al. | 72/453.13 |
| 4,796,460 | A | 1/1989 | Smedberg et al. | 72/453.13 |
| 4,825,681 | A | 5/1989 | Smedberg et al. | 72/453.13 |
| 4,860,571 | A | 8/1989 | Smedberg et al. | 72/453.13 |
| 4,886,251 | A | 12/1989 | Haussermann | 267/140.1 |
| 4,930,336 | A | 6/1990 | Smedberg et al. | 72/453.13 |
| 5,219,051 | A | 6/1993 | Davis | 188/378 |
| 5,366,048 | A | 11/1994 | Watanabe et al. | 188/267 |
| 5,477,946 | A | 12/1995 | Kawamata et al. | 188/267 |
| 5,499,525 | A | 3/1996 | Kordak et al. | 72/453.03 |
| 5,794,482 | A | 8/1998 | Walkin | 72/350 |
| 5,966,981 | A | 10/1999 | Janos et al. | 72/350 |
| 6,237,381 | B1 | 5/2001 | Smedberg et al. | 72/19.9 |

*Primary Examiner*—David Jones
(74) *Attorney, Agent, or Firm*—McAndrews, Held & Malloy, Ltd.

(57) ABSTRACT

This invention relates to a hydraulic force modulator used in a power press to provide a predetermined force with a defined force applied by a ram of the press at defined incremental positions of the ram relative to a stationary part of the press. A moveable plate moves relative to a base plate. A resilient pneumatic bellows has one end sealingly mounted on the moveable plate. The resilient pneumatic bellows has an opposite end sealingly mounted on the base plate. A vessel is connected on one of the plates. A metering cylinder is mounted on the same plate as the vessel and is positioned within the vessel. A piston assembly is mounted in the metering cylinder. A piston rod has one end connected to the piston assembly and the opposite end connected to the other of the plates. The metering cylinder has a plurality of orifices regulate the flow of hydraulic fluid from the metering cylinder into the vessel as the piston assembly moves from a starting position and thereby regulates the force on the piston rod in response to the position of the moveable plate relative to the base plate and thereby co-acts with the defined force applied by the ram.

19 Claims, 6 Drawing Sheets

POWER PRESS

CROSS-REFERENCE TO RELATED APPLICATIONS

This application is a continuation of U.S. Ser. No. 09/203,133, filed Dec. 1, 1998, to be issued as U.S. Pat. No. 6,237,381 on May 29, 2001. U.S. Ser. No. 09/203,133 is incorporated by reference in full to provide continuity of disclosure.

STATEMENT REGARDING FEDERALLY SPONSORED RESEARCH OR DEVELOPMENT

Not Applicable.

BACKGROUND OF THE INVENTION

Power presses are built in a wide variety of styles and sizes to perform a variety of functions, such as stamping, drawing, forming and many others. The deleterious effect of impact loading associated with many functions of power presses is well known and recognized. A variety of cushion arrangements for use in power presses is well known. Examples of such cushion arrangements associated with power presses are taught in: U.S. Pat. No. 4,732,033, entitled, "Pneumatic Die Cushion," issued Mar. 22, 1988, to Smedberg, et al.; U.S. Pat. No. 4,736,615, entitled, "Pneumatic Press Counterbalance", issued Apr. 12, 1988, to Smedberg, et al.; U.S. Pat. No. 4,796,460 entitled, "Cushion Construction Including Snubber", issued Jan. 10, 1989, to Smedberg, et al; U.S. Pat. No. 4,825,681, entitled, "Pneumatic Press Counterbalance and Cushion Construction", issued May 2, 1989 to Smedberg, et al.; U.S. Pat. No. 4,860,571, entitled, "Power Press With Improved Cushioning System", issued Aug. 29, 1989, to Smedberg, et al; and U.S. Pat. No. 4,930,336, entitled, "Single Action Cylinder", issued Jun. 5, 1990, to Smedberg, et al.

Though cushioning improves operation of a power press, it is still necessary to provide a means to modulate the force applied by a press ram to work piece and stationary portions of the press to reduce further the deleterious effect of undesired shock loading on parts of the press and to achieve a smooth application of force to a work piece.

SUMMARY OF THE INVENTION

The herein disclosed invention provides an improved power press. This press construction provides improved holding of a work piece and generates an improved desirable loading in a power press. An improved force modulator is used to hold the work piece and to regulate the internal loading in the press having a ram moveable relative to a stationary part of the press. The force modulator includes a vessel with hydraulic fluid contained in the vessel. A hydraulic fluid container is mounted within the vessel. One end of the force modulator is connected to the press ram. An opposite end of the force modulator is connected to the stationary part of the power press. A regulator is connected to the container to control the flow of hydraulic fluid into the vessel thereby determine a back force on the press ram congruent with a defined force displacement curve, that is, the defined force for each incremental ram position in response to the position of the ram relative to the stationary part of the press. The back force on the press ram substantially eliminates undesirable impact loading on parts of the press and achieves a smooth application of a working force to a work piece positioned in the press.

DESCRIPTION OF THE PREFERRED EMBODIMENT

Figure 1:
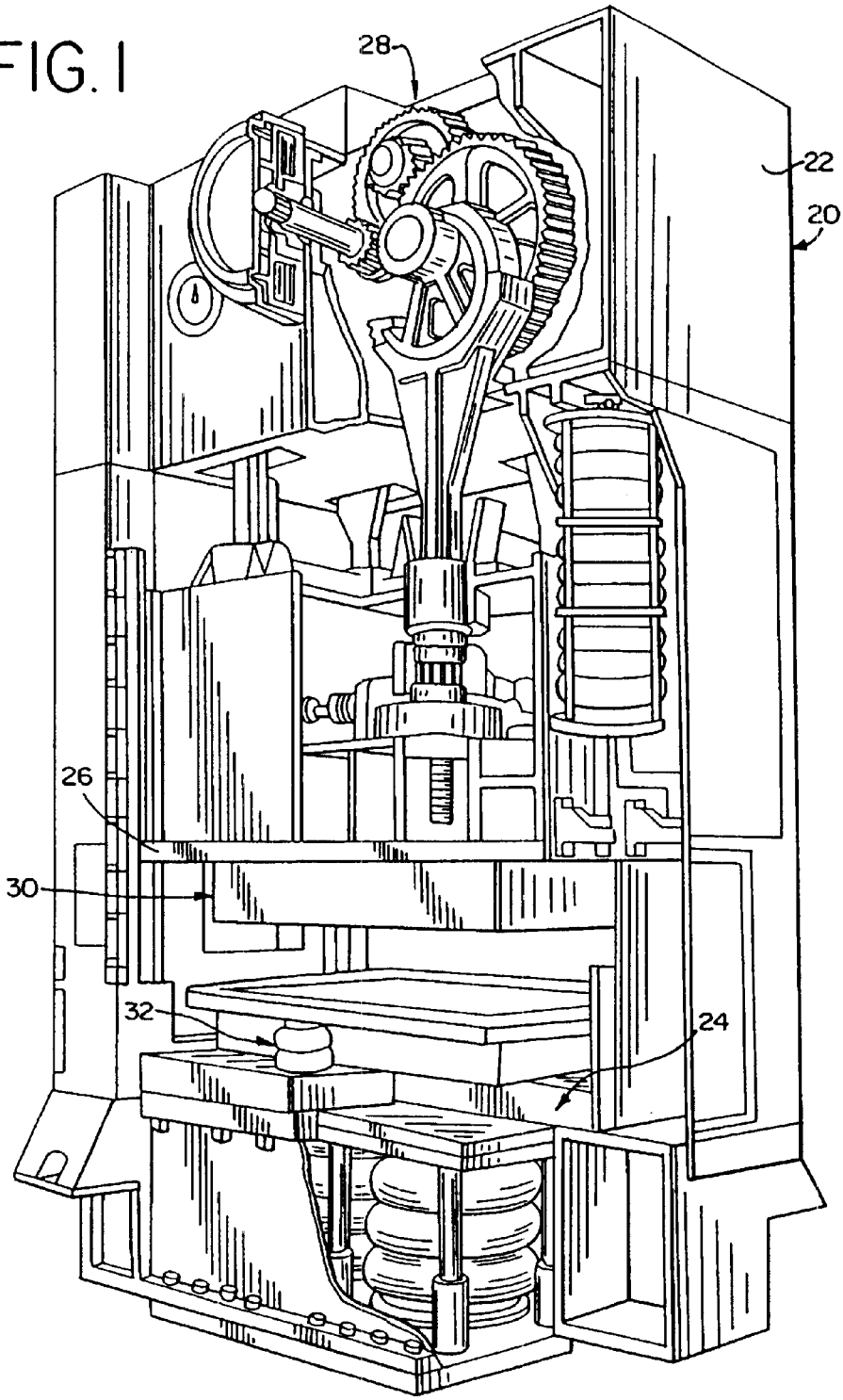
FIG. 1 is a perspective view of a conventional power press having an improved force modulator mounted therein to provide an effective back force on a press ram congruent with a defined force displacement curve for the ram which is responsive to the position of the ram in relation to a stationary part of the press.

Referring now the drawings and especially to FIG. 1, a conventional power press generally indicated by numeral 20 is shown therein. Power press 20 is conventional, in that, it includes a conventional frame 22 with a conventional bolster 24 fixed within the frame. The bolster is a stationary portion of the press. A conventional ram 26 is movably mounted in the frame and is driven by a conventional drive assembly 28 from a conventional and well known power source not shown herein. A die assembly 30 is mounted within the press with four force modulators 32 (any appropriate number may be used) connected to the die assembly and bolster 24 though only two force modulators are shown in FIGS. 2, 3 and 4.

Figure 4:
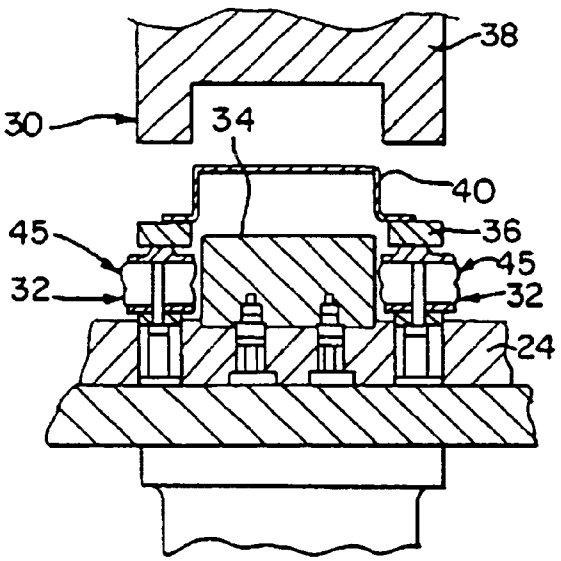
FIG. 4 is similar to FIGS. 2 and 3, but showing the moveable portion of the die retracted and a work piece resting on the die ring positioned out of engagement with a male portion of the die.
Figure 3:
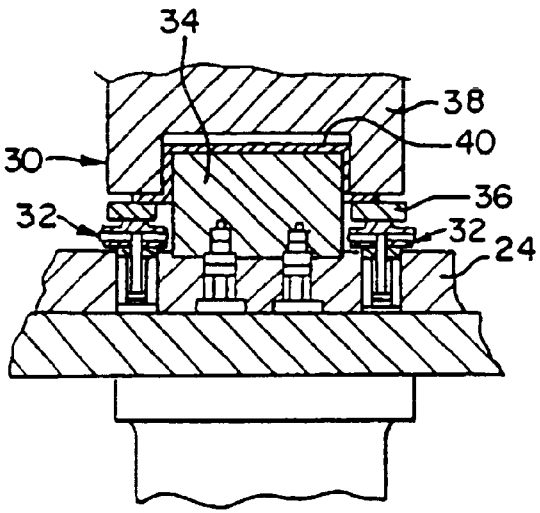
FIG. 3 is a cross sectional view similar to FIG. 2, but showing the moveable portion of the die in engagement with a work piece forming a work piece to a desired form.
Figure 2:
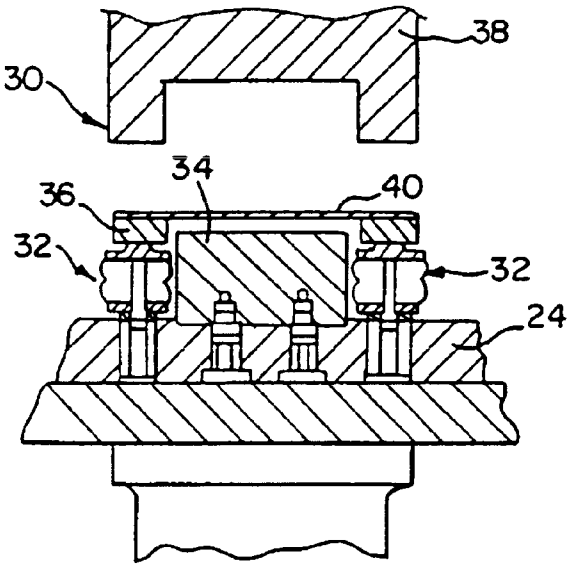
FIG. 2 is a cross sectional view showing a die arrangement in the power press shown in FIG. 1 with a work piece mounted in the die on a die ring with a moveable portion of the die positioned for engagement with the work piece and force modulators connected to the die ring.

As may be seen in FIGS. 2, 3 and 4, die assembly 30 includes a male stationary portion 34 fixed to the bed. A movable die ring 36 is positioned adjacent to and surrounding male 34. The die ring extends above male portions 34 as may be seen in FIGS. 2 and 4. A conventional female or moveable portion 38 of the die assembly is mateable with male portion 34. Moveable portion 38 is fixed to ram 26 to move up and down with the ram within frame 22. A work piece 40 is positioned on top of the die ring, as may be seen in FIG. 2. A plurality of identical force modulators 32 is mounted in bolster 24 and in engagement with bed ring 36. When the female portion 38 moves down into engagement with work piece 40, the work piece is locked at its outer periphery between the female portion and the die ring. Further downward movement of the ram causes the central portion of the work piece to be drawn around the stationary male portion. The force modulator is connected to the ram through the ring, the work piece and the moveable die portion. After the ram has completed its downward stroke, the ram is moved upward, which allows the die ring to move upward, and disengage the work piece from the male portion of the die, as shown in FIG. 4. The work piece is then removed in a conventional and well known manner and a new work piece is positioned in the die in the attitude shown in FIG. 2.

Each forming operation in the die requires a given force to be applied by the ram to the work piece to draw the work piece a selected amount. The given force varies incrementally in relation to the position of the ram relative to the bed as a defined force in a determined force displacement curve. The ram's downward motion is simple harmonic motion, wherein the initial vertical movement is slight. Then, the rate of the downward movement increases to a midpoint in the total displacement of the ram. After the midpoint, the rate of downward movement then decreases until the ram reaches the end of its downward stroke and starts to return to its starting position. Through each incremental position, the ram's defined force upon each work piece is observed relative to the bed to generate the defined force displacement curve for the given work piece.

The four force modulators 32 cooperate to provide a predetermined part holding force with the applied force from the ram to smooth out the force applied to the parts of the power press. The utilization of the predetermined force against the force of the ram reduces the deleterious effect of extraneous forces within the press generated by the ram. The hydraulic force modulators create the proper part holding force through the action of a piston assembly 41, which may be seen in FIG. 5, moving within a container, that is, a metering cylinder 42, which is an elongated tube, to force a conventional and well known hydraulic fluid from the metering cylinder through a plurality of metering orifices 43. The amount of predetermined force is determined by the rate of flow of hydraulic fluid through the metering orifices. The initial number of orifices is large in view of the fact that the ram moves but a small amount initially. In this instance, the number of effective orifices becomes less as the ram moves further down toward the bed, until the ram bottoms out and there is one orifice.

Figure 5:
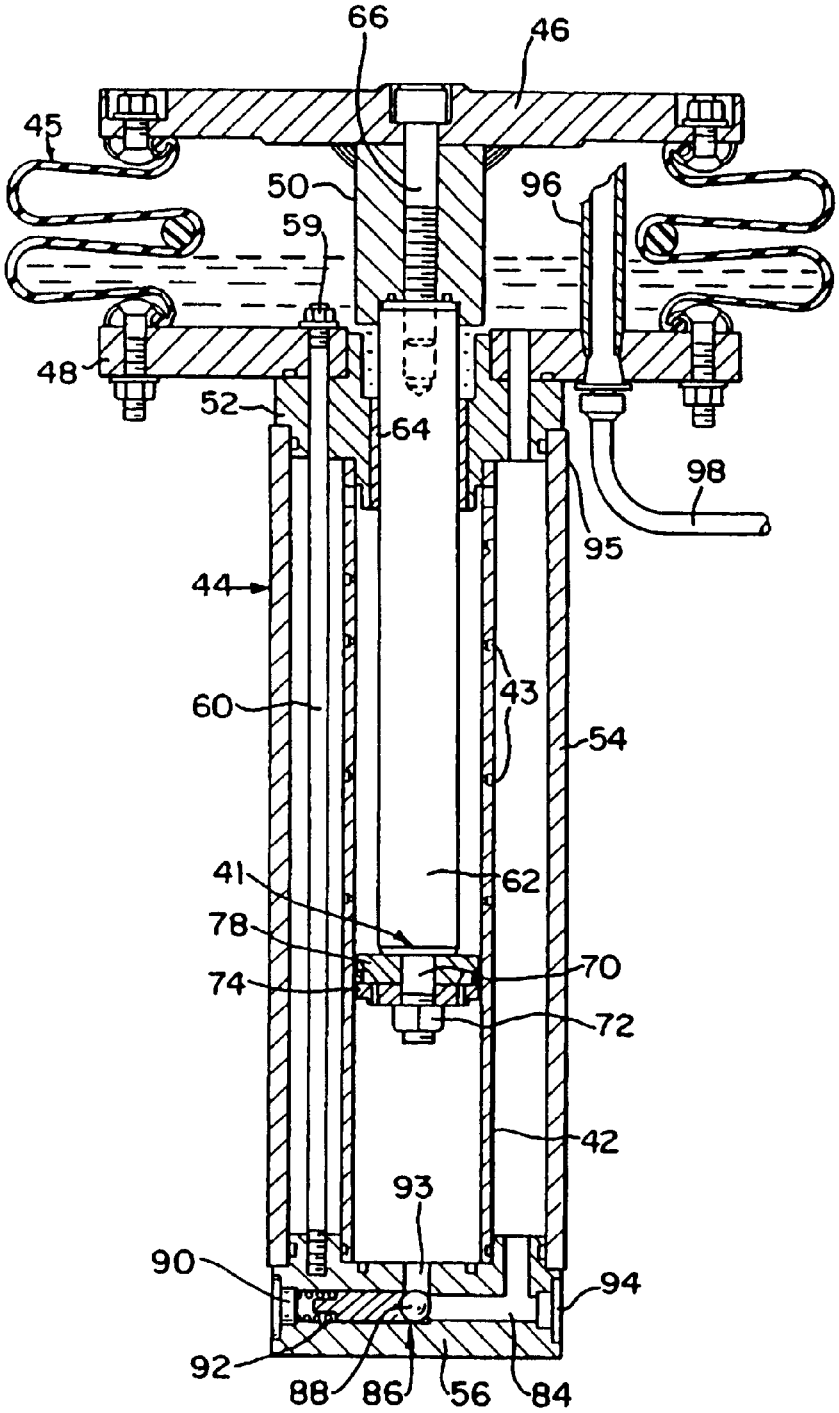
FIG. 5 is an enlarged cross sectional view of a force modulator shown in FIGS. 1, 2, 3 and 4 and showing the force modulator in a collapsed attitude, as shown in FIG. 3.
Figure 6:
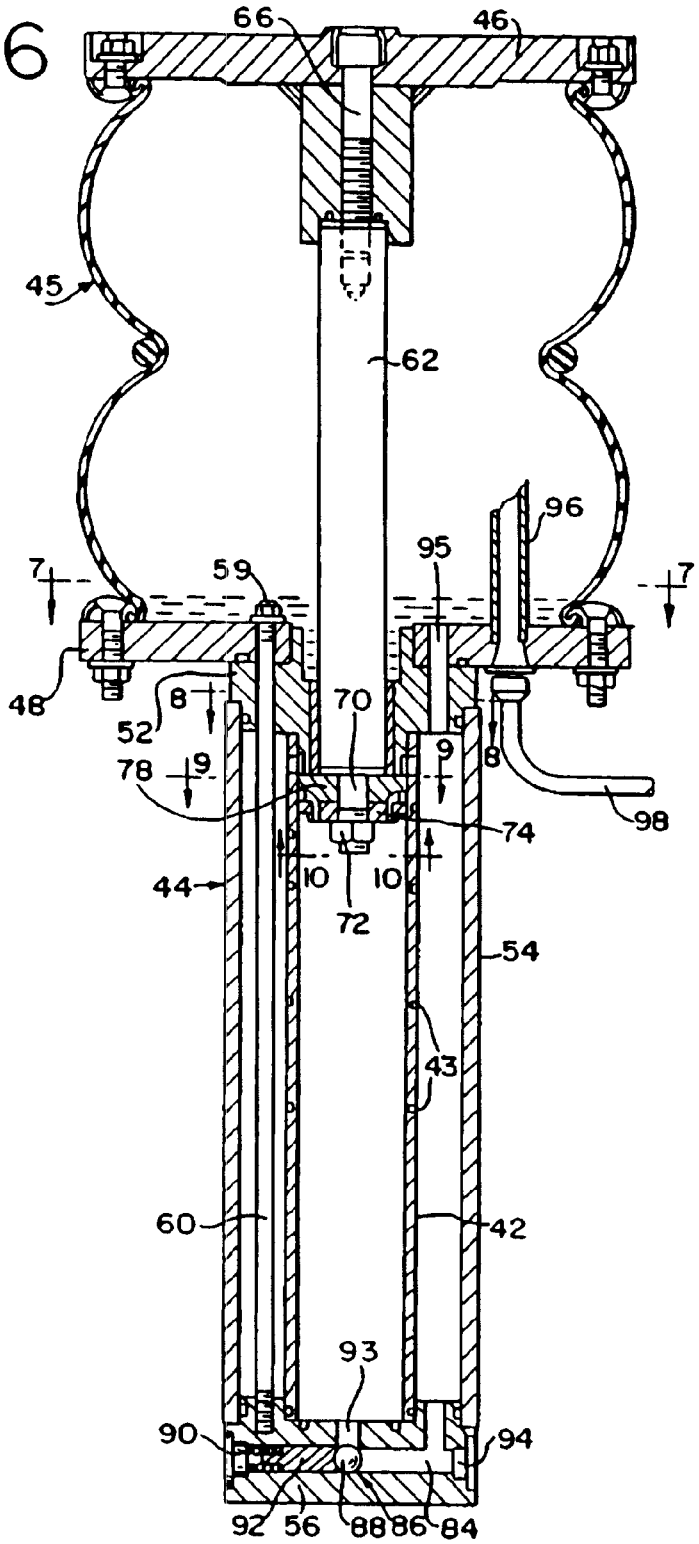
FIG. 6 is a cross sectional view of the force modulator of FIG. 5, but showing the force modulator in an expanded attitude as shown in FIGS. 2 and 4.
Figure 7:
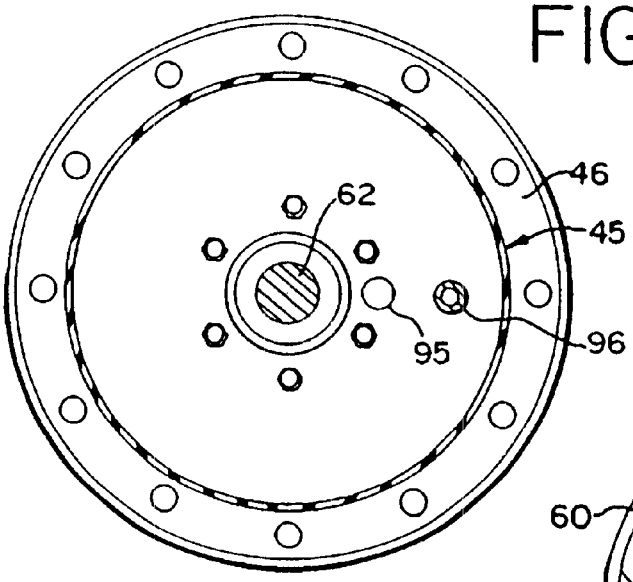
FIG. 7 is an enlarged cross sectional view taken on Line 7—7 of FIG. 6.
Figure 8:
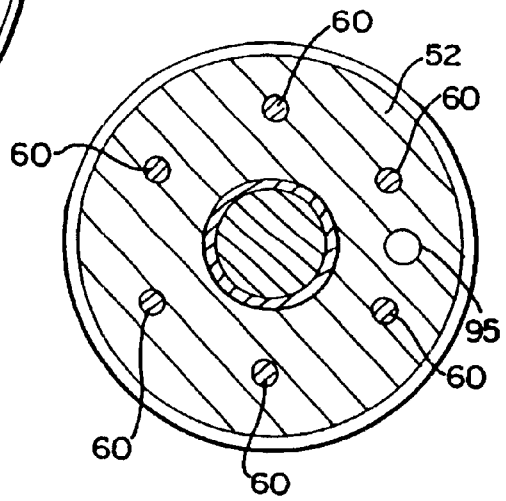
FIG. 8 is an enlarged cross sectional view taken on Line 8—8 of FIG. 6 showing the arrangement of parts through a head of the force modulator.
Figure 9:
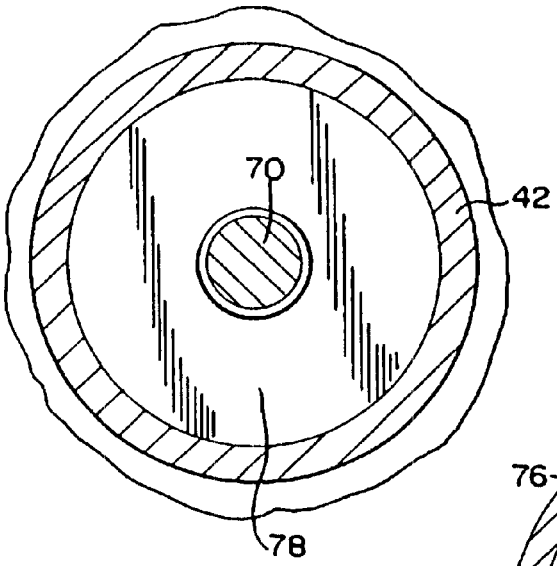
FIG. 9 is an enlarged cross sectional view taken on Line 9—9 of FIG. 6.
Figure 10:
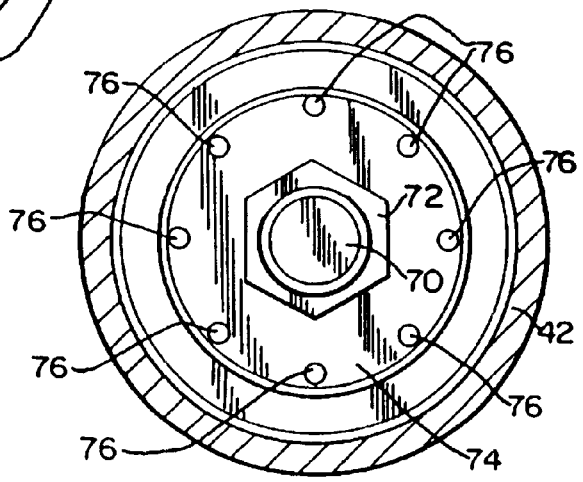
FIG. 10 is an enlarged cross sectional view taken on Line 10—10 of FIG. 6.

A specific construction of each force modulator 32 is identical to each other force modulator and the construction shown in detail in FIGS. 5 and 6. Force modulator 32 generally includes a hydraulic cylinder 44 and a conventional resilient pneumatic bellows 45 connected to the cylinder. A moveable base plate 46 is connected to die ring 36. A fixed base plate 56 is connected to bolster 24. The pneumatic bellows has one end sealingly secured to fixed base plate 48 and its opposite end is secured to moveable plate 46. A stop 50 is welded to the moveable base plate 46.

Cylinder 44 includes a piston head 52 which is sealingly mounted in fixed plate 48. The cylinder includes a container cylinder or vessel 54, which has one end sealingly connected to the head 52. A closed end head 56 is sealingly connected to the other end of vessel 54. Metering cylinder 42 is concentric with vessel 54 and has one end sealingly secured to the piston head 52 and the other end sealingly secured to the closed end head 56. A plurality of identical elongated tie rods 60 are threadedly mounted in closed end head 56 and extend through head 52 and plate 58. A conventional tie rod nut 59 is threaded on the end of each tie rod extending through plate 58 to secure vessel 54 and metering cylinder 42 in position.

Cylinder 44 includes a piston rod 62 which is slidably mounted in head 52 with a bearing 64 positioned therein to guide the rod in head 52. Piston rod 62 is secured to stop 50 by a screw 66. Piston assembly 41 is mounted on the free end of rod 62. Rod 62 includes a piston stud 70 which receives piston assembly 41. A conventional nut 72 secures the piston assembly to the piston rod.

Figure 11:
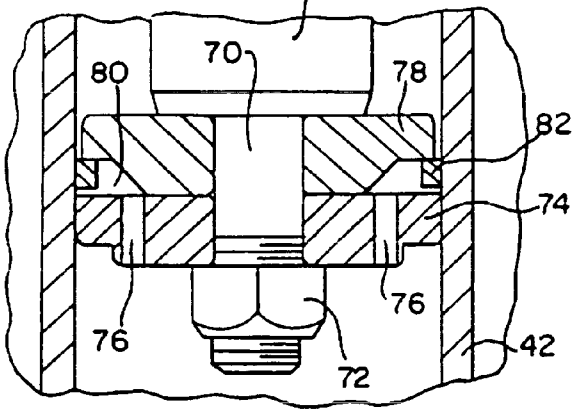
FIG. 11 is an enlarged cross sectional view through a piston assembly of the force modulator showing a sealing ring in contact with a piston guide in a sealed position for preventing the flow of fluid past the piston assembly during a down stroke.
Figure 12:
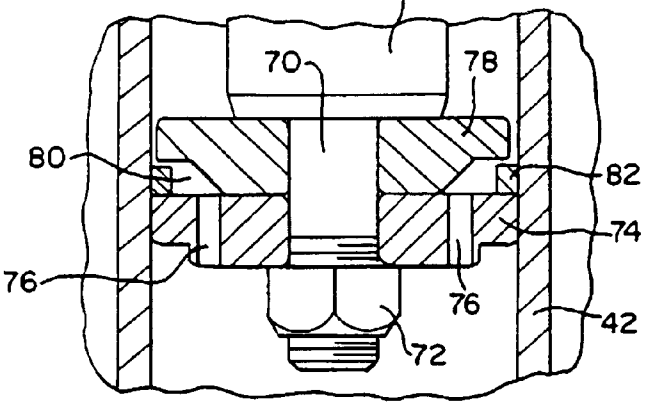
FIG. 12 is an enlarged cross sectional view similar to FIG. 11, but showing the sealing ring in a displaced position relative to the piston guide to allow hydraulic fluid to flow past the piston assembly during an up stroke.

As may be best seen in FIGS. 11 and 12, piston assembly 41 includes a piston 74 which has a plurality of ports 76 extending therethrough. A piston guide 78 is mounted on stud 70 in engagement with piston 74. The outside diameter of the piston guide is less than the inside diameter of the metering cylinder allowing hydraulic fluid to flow between the piston guide and the metering cylinder. Piston guide 78 includes a recess 80 adjacent to the piston. A piston ring 82 is movably mounted in recess 80. Piston ring 82 sealingly engages the interior of the metering cylinder. However, the piston ring is moveable from sealing engagement with the piston guide to engagement with the piston. When the piston ring is in engagement with the piston, hydraulic fluid may flow through ports 76, past the piston ring and the piston guide during return of the piston assembly from its bottom position shown in FIG. 5 to its starting position adjacent to piston head 52 shown in FIG. 6

Closed end head 56 includes a fluid passage 84 between the metering cylinder and vessel 54. A ball check valve 86 is positioned in the passage to control the flow of hydraulic fluid through the fluid passage. Ball check valve 86 includes a ball 88 connected to a spring 90 through a plug 92. The spring urges the ball 88 toward passage 84 so that the ball seats in the passage. A port 93 in fluid passage 84 provides communication for hydraulic fluid between the interior of the metering cylinder and the ball. When pressure is increased within the metering cylinder, the increase in pressure effectively urges the ball into greater contact with the seat in head 56 to seal closed passage 84. However, when the pressure within the metering cylinder is decreased so that the pressure within vessel 54 is greater than the pressure in the metering cylinder, the ball is displaced from its seat to allow hydraulic fluid to flow into the metering cylinder. Passage 84 is connected through a port 94 to a hydraulic fluid supply reservoir, which is not shown herein.

The interior of the vessel communicates with the interior of the pneumatic bellows through an overflow passage 95. Overflow passage 95 allows fluid to flow from the vessel into the pneumatic bellows which acts as an overflow reservoir. A tube 96 is mounted in plate 48 and is connected to a conventional source of compressed air, not shown therein, through a line 98. Tube 96 extends above the maximum of height of hydraulic fluid in the pneumatic bellows.

The defined force applied to the ram at its incremental positions relative to the stationary part of the press has a predetermined force generated by the force modulators for each position. The predetermined force generated by each of the force modulators is determined by the number of orifices in each force modulator which allow the hydraulic fluid to flow out of the respective metering cylinder. The defined force for each force modulator is determined by the pressure drop across the orifices, which is determined by the following formula:

$$\Delta P = \frac{Q^2 \rho}{236^2 d_0^4 c^2}$$

Wherein:

ΔP=pressure drop across the orifices in pounds per square inch

Q=the rate of flow in gallons per minute $d_0$=orifice diameter in inches c=flow coefficient.

ρ=density in pounds per foot$^3$

Figure 13:
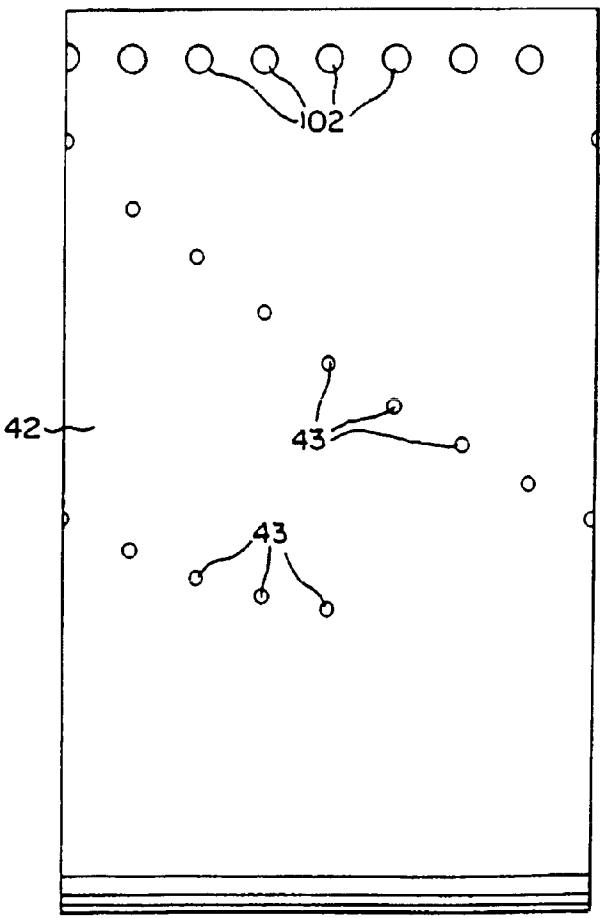
FIG. 13 is a rolled out or flattened view of a metering cylinder showing the positioning of metering holes in the cylinder to effect a selected back force for various incremental positions of the ram.

The pattern of orifice placement in the force modulators is shown in FIG. 13, wherein orifices 43 are positioned axially along the length of the cylinder matched with the speed of the ram to effect the desired predetermined force. At the top of the cylinder, that is, adjacent to head 52, a plurality of orifices 102 is formed therein.

When the ram starts its initial downward movement, the initial force is small, thus, reducing the initial impact. As the ram moves down and into engagement with the work piece, the back pressure builds up to be congruent with the force applied to the work piece by the ram. Thus, the force modulators follow the motion of the ram to maintain a predetermined force on the ram. The inward movement of the piston assembly for each force modulator from its starting position as shown in FIG. 6 causes the hydraulic fluid contained in the metering cylinder to be pushed out of the cylinder into vessel 54 through orifices 43. The ball check valve prevents any flow of hydraulic fluid out of the end of the metering cylinder. The piston rod takes up a volume within the metering cylinder greater than that which was originally taken up by the piston so that there is an excess of hydraulic fluid in the metering cylinder between the piston assembly and head 52. The hydraulic fluid passes through overflow passage 95 into the pneumatic bellows were it is retained.

The inward movement of the piston assembly does not allow any hydraulic fluid to flow past the piston. As may be seen in FIG. 11, when the piston assembly moves toward head 56, sealing ring 82 engages piston guide 78, thereby preventing the flow of fluid past the guide. Thus, the hydraulic fluid cannot pass the piston assembly. When the ram reaches the bottom of its stroke, that is, the position shown in FIG. 3, stop 50 is positioned adjacent to head 52 and thereby prevents the further movement of the piston assembly into the metering cylinder. As the ram retracts, the force modulator expands, that is, the pneumatic bellows filled with compressed air acts as a pneumatic operation and raises moveable plate 46 to move the piston assembly toward its starting position. The drain ports 102 allow the hydraulic fluid to flow out of the metering cylinder and into the vessel. The piston assembly also allows the hydraulic fluid to flow through the assembly. The upward movement of the piston assembly places sealing ring 82 into the position shown in FIG. 12 to act as a return valve. The hydraulic fluid passes the piston guide since the sealing ring is disengaged from the piston guide and the hydraulic fluid flows through ports 76 of the piston to the other side of the piston assembly. The movement of the piston assembly to its starting position also causes a decreased pressure in the metering cylinder in the space between the piston assembly and head 56, so that hydraulic fluid from the vessel has a free flow return through passage 84 and past the ball check assembly to flow into the metering cylinder. Thus, the force modulator readily moves into its starting position.

Although a specific embodiment of the herein disclosed invention has been described in detail above, it is readily apparent that those skilled in the art may make various modifications and changes to a specific construction without departing from the spirit and scope of the present invention. It is to be expressly understood that the instant invention is limited only by the appended claims.

What is claimed is:

1. A power press comprising:

a. a stationary die, b. a movable die movable toward the stationary die along a die closing and opening axis, c. a ram for urging the movable die toward the stationary die along the axis, d. a force modulator operatively connected to exert a force in the direction of the axis between the stationary die and the movable die, the force being variable in response to the position of the movable die relative to the stationary die, the force modulator comprising:

e. a base plate, f. a movable plate that is movable relative to the base plate, g. a resilient pneumatic bellows having one end sealingly mounted on the movable plate, said resilient pneumatic bellows having an opposite end sealingly mounted on the base plate, h. a vessel connected to one of said plates, i. a metering cylinder mounted on the same plate as the vessel and being positioned within the vessel, j. a piston assembly slidably mounted in the metering cylinder, k. a piston rod having one end connected to the piston assembly and an opposite end connected to the other of said plates, said metering cylinder having a plurality of orifices along its length to regulate the flow of hydraulic fluid from the metering cylinder into the vessel as the piston assembly moves from a starting position into the metering cylinder and thereby regulate a force on the piston rod in response to the position of the movable plate relative to the base plate and thereby coact with the defined force applied by the ram.

2. A power press as defined in claim 1, wherein the pneumatic bellows is a pneumatic operator to return the piston to a starting position.

3. A power press as defined in claim 1, including a return valve mounted in the piston assembly to allow hydraulic fluid to flow from one side of the piston assembly to the other side of the piston assembly to facilitate return of the piston assembly to a starting position.

4. A power press as defined in claim 1, including a fluid passage between the metering cylinder and the vessel, and a check valve in the fluid passage to prevent flow of hydraulic fluid through the fluid passage in one direction and allow hydraulic fluid to flow in the opposite direction to facilitate return of the piston to a starting position.

5. A power press as defined in claim 1, said piston assembly including a piston guide mounted on the piston rod cooperative with a piston, and a sealing ring mounted between the piston and the piston guide to prevent flow of hydraulic fluid past the piston in one direction and to allow free flow of hydraulic fluid in the other direction to facilitate return of the piston to a starting position.

6. A power press as defined in claim 1, including a return valve mounted in the piston assembly to allow hydraulic fluid to flow from one side of the piston assembly to the other side of the piston assembly to facilitate return of the piston assembly to a starting position, and the pneumatic bellows provides a pneumatic operator to return the piston assembly to the starting position.

7. A power press as defined in claim 1, including a fluid passage between the metering cylinder and the vessel, and a check valve in the fluid passage to prevent flow of hydraulic fluid through the fluid passage and in one direction and allow hydraulic fluid to flow in the opposite direction to facilitate return of the piston to a starting position, and the pneumatic bellows provides a pneumatic operator to return the piston assembly to the starting position.

8. A power press as defined in claim 1, including a fluid passage between the metering cylinder and the vessel, a check valve in the fluid passage to prevent flow of hydraulic fluid through the fluid passage in one direction and allow hydraulic fluid to flow in the opposite direction, and a return valve mounted in the piston assembly to allow hydraulic fluid to flow from one side of the piston assembly to the other side of the piston assembly to facilitate return of the piston assembly to a starting position.

9. A power press as defined in claim 1, including a fluid passage between the metering cylinder and the vessel, a check valve in the fluid passage to prevent flow of hydraulic fluid through the fluid passage in one direction when the movable plate moves toward the base plate and to allow hydraulic fluid to flow in the opposite direction in the fluid passage when the movable plate moves away from the base plate, said piston assembly includes a piston guide mounted on the piston rod cooperative with a piston, and a sealing ring mounted between the piston and the piston guide to prevent the free flow of hydraulic fluid past the piston in one direction when the movable plate moves toward the base plate and to allow free flow of hydraulic fluid in the other direction when the movable plate moves away from the base plate.

10. A power press as defined in claim 1, including a fluid passage between the metering cylinder and the vessel, a ball check valve in the passage to prevent flow of hydraulic fluid through the fluid passage when the movable plate moves toward the base plate and to allow hydraulic fluid to flow in the opposite direction when the movable plate moves away from the base plate, said piston assembly including a piston guide mounted on the piston rod cooperative with a piston, and a sealing ring mounted between the piston and the piston guide sealingly engageable with the metering cylinder to prevent the free flow of hydraulic fluid past the piston when the movable plate moves toward the base plate and to allow the free flow of hydraulic fluid in the other direction when the movable plate moves away from the base plate to facilitate return of the piston assembly to a starting position, and the pneumatic bellows provides a pneumatic operator to return the piston assembly to a starting position by urging the movable plate away from the base plate.

11. A power press as defined in claim 1, wherein said metering cylinder has one end sealingly connected to the base plate, said vessel is a cylinder coaxial with said metering cylinder, said vessel having one end sealingly connected to the base plate, a head sealingly connected to the opposite end of the metering cylinder, said head sealingly connected to the opposite end of the vessel, a plurality of tie rods securing the head to the metering cylinder and to the vessel, said head containing a fluid passage connecting the metering cylinder and the vessel, a ball check valve mounted in the fluid passage to allow hydraulic fluid to flow from the vessel into the metering cylinder and to restrict the flow of hydraulic fluid from the metering cylinder into the vessel, said metering cylinder having a plurality of apertures adjacent to the one end adjacent to the base plate to allow hydraulic fluid to flow from the metering cylinder into the vessel when the piston moves toward its starting position, said piston assembly including a piston guide mounted on the piston rod adjacent to a piston, said piston having a plurality of piston ports to allow hydraulic fluid to flow through the piston, and a sealing ring mounted on the piston rod between the piston and the piston guide in sealing engagement with the metering cylinder, the sealing ring being engageable with the piston guide to effect a seal between the ring and the guide to prevent the free flow of hydraulic fluid past the piston when the moveable plate moves toward the base plate, said sealing ring being positionable in engagement with the piston and spaced from the piston guide to allow free flow of hydraulic fluid to pass the piston to facilitate return of the piston to its starting position, and a relief passage from the vessel to the pneumatic bellows to allow excess hydraulic fluid expelled into the vessel from the metering cylinder to flow into the pneumatic bellows.

12. A power press comprising:

a. a stationary portion, b. a press ram movably mounted to advance toward and retract away from the stationary portion, c. a die assembly having a first portion connected to the ram and a second portion connected to the stationary portion and mateable with the first portion; and d. a force modulator exerting a force on the press ram, when the press ram is advancing toward the stationary portion, that is a function of the position of the ram relative to the stationary portion, and of the speed of the ram advancing toward the stationary portion of the press.

13. A power press as defined in claim 12, wherein the force modulator includes a vessel, hydraulic fluid in the vessel, and a regulator controlling the flow of hydraulic fluid from the vessel to exert the force on the press ram.

14. A power press as defined in claim 13, further comprising a die ring surrounding the second portion and connected to the force modulator, the die ring releasably secured to a work piece to hold a peripheral portion of the work piece between the die ring and one of the portions of the die assembly while the work piece is formed by the die assembly.

15. A power press as defined in claim 1, wherein the force modulator is expandable and includes a vessel, hydraulic fluid contained in the vessel, a hydraulic fluid container mounted on the vessel, and a regulator connected to the container directing the flow of hydraulic fluid from the vessel, said regulator including a piston moveable in response to the movement of the ram, said container including an elongated tube receiving the piston, said tube having a plurality of spaced apertures along the length of the tube for regulating the rate of flow of hydraulic fluid out of said container, a free flow return in said force modulator to allow hydraulic fluid to flow freely from the vessel into the container as the force modulator expands, and a pneumatic operator connected to the stationary part of the press for expanding the force modulator concurrent with movement of the ram away from the stationary part of the press.

16. A power press as defined in claim 14, wherein one of the first and second portions is a female portion, the other of the first and second portions is a male portion, and the die assembly is adapted to hold the work piece between the die ring and the female portion while a portion of the work piece within the peripheral portion is formed on the male portion.

17. A power press as defined in claim 12, wherein the force modulator comprises:

a. a piston having a leading portion moveable in response to the movement of the ram between first and second axial extremities of travel;

b. a metering cylinder having a cylindrical inner wall receiving the piston and allowing axial travel of the piston leading portion within the inner wall between the first and second extremities of travel, the piston and the cylinder defining at least part of a variable volume enclosure for receiving a working fluid, the enclosure having its greatest volume when the piston leading portion is at its first extremity of travel;

c. a fluid supply for interposing a working fluid in the enclosure; and d. a plurality of fluid outlets for passing the working fluid out of the enclosure, at least one fluid outlet being located on the cylindrical inner wall between the first and second extremities of travel of the piston leading portion.

18. A power press as defined in claim 17, wherein the force modulator further comprises a free flow return to allow a working fluid to flow freely into the enclosure as the piston leading portion moves toward its first extremity of travel.

19. A power press as defined in claim 17, further comprising a fluid operator for moving the piston leading portion toward its first extremity of travel concurrent with movement of the ram away from the stationary part of the press.

* * * * *